US007926852B2

(12) United States Patent
Geminn

(10) Patent No.: US 7,926,852 B2
(45) Date of Patent: Apr. 19, 2011

(54) MANIFOLD FLANGE

(75) Inventor: Markus Geminn, St. Martin (DE)

(73) Assignee: Heinrich Gillet GmbH, Edenkoben (DE)

( * ) Notice: Subject to any disclaimer, the term of this patent is extended or adjusted under 35 U.S.C. 154(b) by 0 days.

(21) Appl. No.: 12/000,018

(22) Filed: Dec. 6, 2007

(65) Prior Publication Data

US 2008/0136182 A1 Jun. 12, 2008

(30) Foreign Application Priority Data

Dec. 9, 2006 (DE) ..... 20 2006 018 649 U

(51) Int. Cl.
*F01N 7/00* (2006.01)
*F16L 39/00* (2006.01)

(52) U.S. Cl. ..... 285/124.1; 285/124.3; 285/288.1; 285/416; 60/323

(58) Field of Classification Search ..... 60/323; 165/173; 277/591, 597, 598, 600; 285/124.1, 285/124.3, 288.1, 416
See application file for complete search history.

(56) References Cited

U.S. PATENT DOCUMENTS

| | | | | |
|---|---|---|---|---|
| 1,913,736 | A * | 6/1933 | Victor | 277/591 |
| 1,932,539 | A * | 10/1933 | Victor | 277/597 |
| 4,211,205 | A * | 7/1980 | Lockhart | 123/193.3 |
| 4,813,691 | A * | 3/1989 | Schoenborn | 277/598 |
| 5,725,223 | A * | 3/1998 | Yamada et al. | 277/595 |
| 5,947,483 | A * | 9/1999 | Brummer et al. | 277/592 |
| 6,155,045 | A * | 12/2000 | Durr et al. | 60/323 |
| 6,189,895 | B1 * | 2/2001 | Yamada | 277/591 |
| 6,254,142 | B1 * | 7/2001 | Kaifel et al. | 285/124.1 |
| 6,533,287 | B1 * | 3/2003 | Belter | 277/598 |
| 6,702,062 | B2 * | 3/2004 | Kusabiraki et al. | 181/240 |
| 6,893,024 | B2 * | 5/2005 | Belter | 277/598 |
| 6,935,635 | B2 * | 8/2005 | Matsushita | 277/592 |
| 6,974,137 | B2 * | 12/2005 | Beutter et al. | 277/598 |
| 2003/0102636 | A1 * | 6/2003 | Belter | 277/591 |
| 2004/0113370 | A1 * | 6/2004 | Beutter et al. | 277/591 |
| 2004/0200449 | A1 * | 10/2004 | Lang | 123/184.21 |
| 2006/0006609 | A1 * | 1/2006 | Sandford et al. | 277/595 |
| 2006/0279047 | A1 * | 12/2006 | Bien et al. | 277/591 |

FOREIGN PATENT DOCUMENTS

| | | | |
|---|---|---|---|
| EP | 861975 | A2 * | 9/1998 |
| JP | 04124454 | A * | 4/1992 |

* cited by examiner

*Primary Examiner* — James M Hewitt

(74) *Attorney, Agent, or Firm* — Muncy, Geissler, Olds & Lowe, PLLC

(57) ABSTRACT

A manifold for mounting on the cylinder head of internal combustion engines includes a manifold housing, a pipe connecting flange, and, for each cylinder, an individual flange with a fastener. To make handling easier, adjacent individual flanges are joined by an expansion arch.

7 Claims, 3 Drawing Sheets

MANIFOLD FLANGE

This nonprovisional application claims priority under 35 U.S.C. §119(a) to German Patent Application No. DE 202006018649, which was filed in Germany on Dec. 9, 2006, and which is herein incorporated by reference.

BACKGROUND OF THE INVENTION

1. Field of the Invention

The present invention relates to manifold flanges for mounting on a cylinder head of internal combustion engines, comprising a manifold housing, a pipe connecting flange, and, for each cylinder, an individual flange with fastening means.

2. Description of the Background Art

Manifold flanges for attaching to the cylinder head of internal combustion engines include a manifold housing, which directs hot exhaust gases emerging from the cylinders to a pipe connecting flange where additional exhaust gas treatment elements are fastened. The fastening of the manifold flange to the cylinder head takes place with the aid of flanges, which are installed with the aid of stud bolts and nuts, or with the aid of screws. A seal is located between the cylinder head and the flange.

The manifold housing is heated to temperatures up to approximately 900° C. by the hot exhaust gases, causing it to expand accordingly. In contrast, the cylinder attachment flanges reach maximum temperatures of approximately 120° C., since over large areas they are in contact with the cylinder head, which is water cooled. The extreme temperature differences result in corresponding differences in expansion which must be compensated. The manifold housing accommodates some of the difference in expansion. The other part of the difference in expansion is compensated by sliding of the cylinder head attachment flange on the seal.

It is a matter of course that the compensation of expansion is optimal when the cylinder head attachment flanges are designed as individual flanges. However, manufacture and installation of manifold flanges with individual flanges is very cumbersome. Each individual flange must be handled individually. Each individual flange must be placed in an installation fixture for installation on the manifold pipes, in which process it is necessary to ensure by suitable means that no interchanging occurs during placement of the three, four, five, etc. individual flanges, which would make the manifold flange defective. This is unsatisfactory.

SUMMARY OF THE INVENTION

It is therefore an object of the present invention to provide manifold flanges for mounting on the cylinder head of internal combustion engines such that they can be handled and installed easily, quickly and reliably, without losing the desired properties for compensating differences in thermal expansion.

In an embodiment, this object is attained in that adjacent individual flanges are joined by expansion arches.

The present invention is based on the principle of connecting the individual flanges by expansion arches, which yield elastically to the motions of thermal expansion while still allowing handling comparable to a conventional sheet-metal flange. Measures for preventing interchange of the individual flanges are totally eliminated.

According to an embodiment of the invention, the arches are a single piece with the individual flanges. This permits production with a single stamping operation, which is to say in the shortest possible time.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
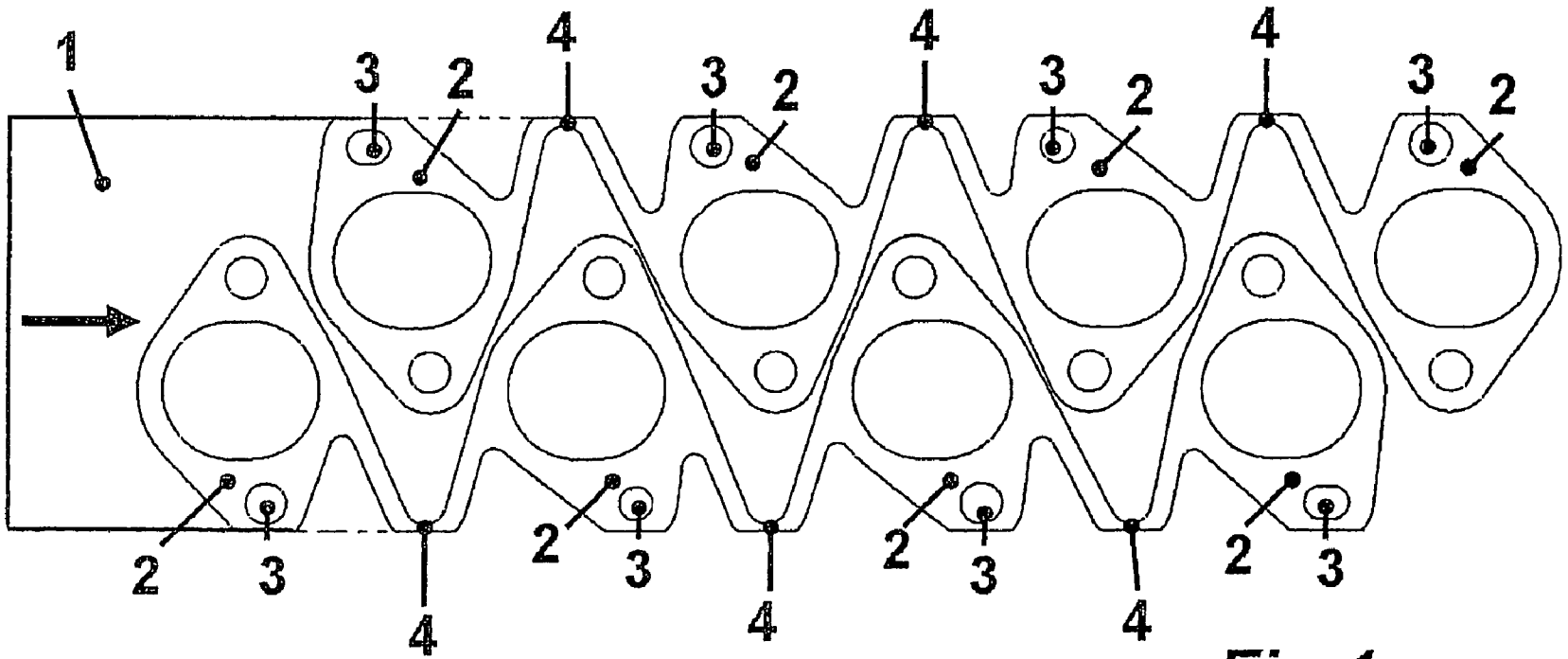
FIG. 1 illustrates two sets of individual flanges, connected by expansion arches, that have been stamped from a sheet of metal.

FIG. 1 shows a metal sheet 1, for example drawn from a coil, out of which are stamped two sets of individual flanges 2 with fastening openings 3. The individual flanges 2 are offset relative to one another for optimization of cuttings.

Adjacent individual flanges 2 of each set are joined together as one piece by an expansion arch 4. These expansion arches 4 are dimensioned such that they are stable enough to allow convenient and reliable handling of the complete set of individual flanges 2 and arches 4, but are also thin and elastic enough to permit movements of thermal expansion during operation of the internal combustion engine.

Figure 2:
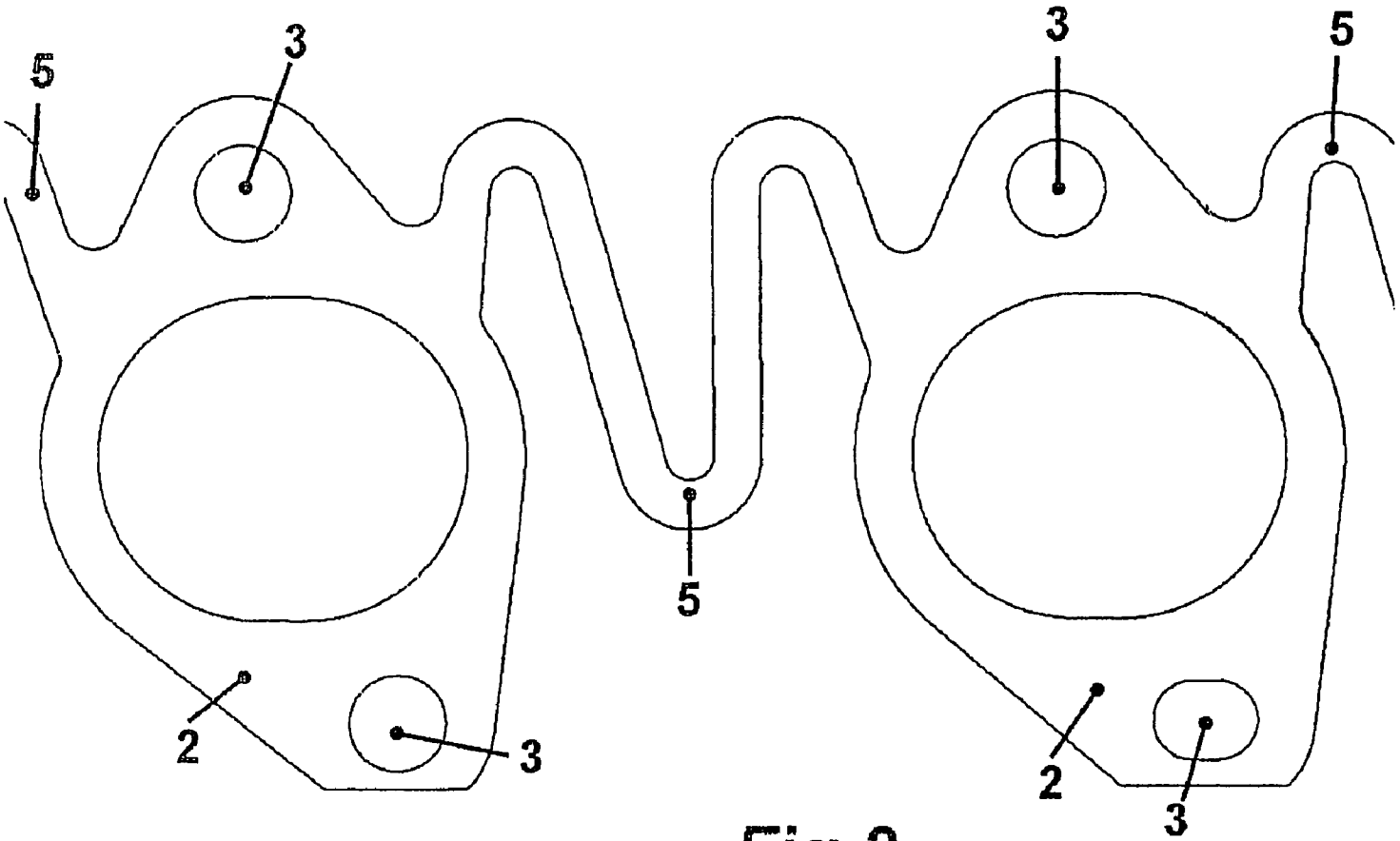
FIG. 2 illustrates part of a set of individual flanges with alternative expansion arches.

FIG. 2 shows an alternative embodiment. In this example, the expansion arches 5 are considerably longer in design in order to improve the elastic characteristics. In any event, however, this embodiment also ensures that the complete set of individual flanges 2 and expansion arches 5 can be handled without problem in the manufacturing plant until the flanges 2 are firmly attached to the manifold housing of the manifold flange.

Figure 3:
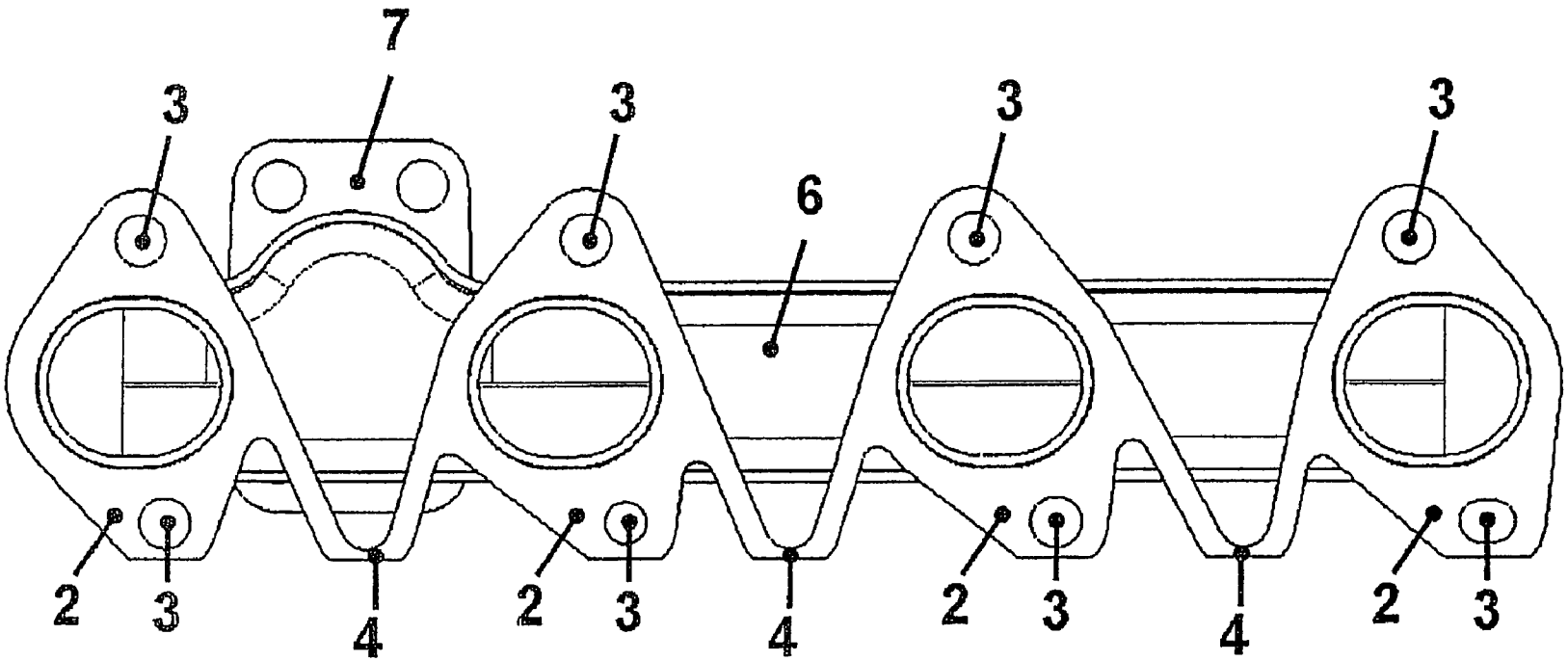
FIG. 3 illustrates a top view of the underside of a complete manifold flange.

FIG. 3 shows a top view of the underside of a complete manifold flange. The individual flanges 2, which are joined by their expansion arches 4, are attached, for example welded, to a manifold housing 6. The manifold housing 6 collects the hot exhaust gases emerging from the cylinders of the internal combustion engine (not shown), and conducts them to a manifold connection with pipe flange 7, which is the mechanism for connecting to the other elements of an exhaust system (not shown).

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A manifold configured to be mounted on a cylinder head of an internal combustion engine, the manifold comprising:

a manifold housing;

a pipe connecting flange;

an individual flange welded to the manifold housing for each cylinder, each individual flange having a fastener; and one expansion arch joining each of two adjacent individual flanges at a time.

2. The manifold according to claim 1, wherein each fastener is an opening.

3. The manifold according to claim 1, wherein each expansion arch permits movement caused by thermal expansion during operation of the internal combustion engine.

4. The manifold according to claim 1, wherein the expansion arches and the individual flanges are formed as a single piece.

5. A manifold configured to be mounted on a cylinder head of an internal combustion engine, the manifold comprising:

a manifold housing configured to collect hot exhaust gases emerging from a cylinder of the internal combustion engine;

a pipe connecting flange;

an individual flange welded to the manifold housing for each cylinder, each individual flange having a fastener; and one expansion arch joining each of two adjacent individual flanges at a time, wherein the individual flanges and expansion arches are stamped from one metal sheet and formed as a single piece, wherein the expansion arches are sufficiently elastic to permit thermal expansions during operation of the internal combustion engine, and wherein, at the same time, the expansion arches are sufficiently stable to permit the complete set of individual flanges and expansion arches to be handled easily and reliably.

6. The manifold according to claim 5, wherein each expansion arch comprises a first curved section connected to a first flange and a second curved section connected to a second flange, the first curved section and the second curved section each being joined by a third curved section.

7. The manifold according to claim 6, wherein the third curved section faces in an opposing direction from the first and second curved sections.

* * * * *